US005938463A

United States Patent [19]

Yodogawa

[11] Patent Number: 5,938,463

[45] Date of Patent: Aug. 17, 1999

[54] SOCKET FOR PRINTED CIRCUIT BOARDS

[75] Inventor: Akihiro Yodogawa, Fujisawa, Japan

[73] Assignee: Berg Technology, Inc., Reno, Nev.

[21] Appl. No.: 08/973,912

[22] PCT Filed: Jun. 6, 1995

[86] PCT No.: PCT/US95/07143

§ 371 Date: Mar. 3, 1998

§ 102(e) Date: Mar. 3, 1998

[87] PCT Pub. No.: WO97/02626

PCT Pub. Date: Jan. 23, 1997

[51] Int. Cl.[6] ..... H01R 13/62

[52] U.S. Cl. ..... 439/326; 439/328

[58] Field of Search ..... 439/325, 326, 439/327, 328

[56] References Cited

U.S. PATENT DOCUMENTS

| | | | |
|---|---|---|---|
| 5,203,714 | 4/1993 | Tuan | 439/326 |
| 5,226,833 | 7/1993 | Lwee | 439/326 |
| 5,413,497 | 5/1995 | Lwee | 439/328 |
| 5,690,502 | 11/1997 | Mochizuki | 439/326 X |
| 5,759,057 | 6/1998 | Cheng et al. | 439/328 |

FOREIGN PATENT DOCUMENTS

| | | |
|---|---|---|
| 0 528 259 A2 | 1/1993 | European Pat. Off. . |
| 0 546 804 A2 | 6/1993 | European Pat. Off. . |

*Primary Examiner*—Khiem Nguyen
*Attorney, Agent, or Firm*—Daniel J. Long; M. Richard Page

[57] ABSTRACT

A socket for a printed circuit board which includes a housing having an insertion inlet defined between one pair of opposed walls to receive a printed circuit board. There are a plurality of spring contacts having their contact points extending at least from one wall into the insertion inlet to provide arrays of contact points along a longitudinal direction of the insertion inlet. A pair of latch arms also each extend from an area near each longitudinal end of the insertion inlet of the housing and each has an integral structure of a cam section and latch section. The cam section is configured so that when the printed circuit board is swung in a direction to press the contact points, each latch arm allows slide motion of a corresponding side edge of the printed circuit board to create a force along the direction of the array of contact points and the latch section latches the side edge of the printed circuit board to swing clear of the cam section. The pair of latch arms are adapted to be returned under their elastic force back to an unlatched position when each latch section unlatches the side edge of the circuit board. One pair of support arms each extend from the housing along the corresponding latch arm and create a gap relative to the adjacent latch arm. A latch guide is fitted in each support arm and has a guide section for allowing the latch arm to be slidingly quicked when the latch arm is moved between the latched position and the unlatched position. The housing, latch arm and support arm are formed of an integral structure of an insulating material.

3 Claims, 6 Drawing Sheets

SOCKET FOR PRINTED CIRCUIT BOARDS

FIELD OF THE INVENTION

The present invention relates to a socket for a printed circuit board which provides a direct-type connector adapted to allow the edge portion of the printed circuit board to be directly inserted as a plug section.

BACKGROUND OF THE INVENTION

With a recent growing demand for a high integration density, various direct type of connectors have been developed as low insertion force types. In general, such a low insertion type connector has a plurality of spring contacts arranged in a socket-formation having of an insulating material with their contact points projected in an insertion inlet into which a printed circuit called a daughter board is inserted. These contact points are arranged as two contact point arrays along the longitudinal direction of the insertion inlet and a gap is created between these contact arrays to receive the edge portion of the printed circuit board. The respective contact point arrays are arranged, in an offset way, in a depth direction of the insertion inlet, that is, in the insertion direction of the printed board. When, on the other hand, the printed circuit board is to be connected, on one surface side of the edge portion the corresponding contact point array is contacted with an area near the forward end of the edge portion of the printed circuit board, while on the other surface side of the printed circuit board the corresponding contact point array is contacted with an area somewhat distant from the forward end of the edge portion of the printed circuit board.

When the edge portion of the printed circuit board is inserted between the contact point arrays and the printed circuit board is swung in a direction in which these contact point arrays are separated from each other, the contact points of the respective spring contacts are displaced and, by a spring force trying to return the contact points back to an initial position, the respective contact points are positively made in contact with corresponding conductors arrayed at the edge portion of the printed circuit board.

In order to positively fix the printed circuit board while holding the respective spring contacts in a better contacting state, a latching mechanism is provided so that the printed circuit board is held in the swung position and fixed to a housing. Various types of latching mechanisms have been developed as such.

The latching mechanism as disclosed, for example, in U.S. Pat. No. 4,986,765 is equipped with a leaf-spring-like latch member formed of a metal sheet and the printed circuit is latched by the metal latch member. The metal latch member has an elastic section in a recess of the housing base, a metal section projected downwardly from the elastic section and inserted into a through bore in the housing base, and a latch section provided above the elastic section. When the printed circuit board is swung, the latch section engages the edge portion of the printed circuit board to externally urge the elastic section and a cutout fitted over the side edge of the printed circuit board so that the printed circuit board is held in a predetermined swung position.

U.S. Pat. No. 5,161,995 discloses a latching mechanism equipped with a leaf-spring-like latch member formed of a metal sheet. The latch member comprises a mount section situated below the elastic section and latch section situated on the upper side. The mount section has one pair of U-shaped mount arms fixedly wound around a support pole situated near the insertion inlet of the printed circuit board.

These mount arms support the reaction force of that spring. Further, the latch section provides a guide face for, upon the swinging of the printed circuit board, engaging with the edge portion of the printed circuit board to outwardly urge the elastic section and an engaging wall for engaging with one face of the printed circuit board to prevent return motion of the printed circuit board.

In either of these latching mechanisms, it is possible to readily latch and unlatch the printed circuit board through the utilization of the characteristic of the metal leaf spring. However, any of the aforementioned latch mechanisms leaves room for improvement in view of the latch members being formed of a metal sheet.

Since, upon the mounting of the printed circuit board, the printed circuit board is swung slidably along the guide sections or guide faces of the latch members to cause the latch members to be bent against their elastic force, there is a risk that a coating layer of the printed circuit board or insulating substrate will be damaged due to the contacting or slide motion of the printed circuit board. In particular, where the printed circuit board per se becomes larger due to the high integration density of the printed circuit board or the number of spring contacts is increased, a greater total force by the spring contacts is required. If the latch member is made correspondingly great in size, a greater force is required to bend the latch member. As a result, there is a greater possibility that the printed circuit board will be damaged.

Further, it is desirable to prevent a metal member other than the contacts, such as a metal member near the insertion inlet of the printed circuit board in particular, from being exposed as much as possible.

It is accordingly the object of the present invention to provide a socket for a printed circuit board which can readily and positively attach and detach the printed circuit board without any associated metal member or members being exposed and can do so even if a greater number of spring contacts are used.

SUMMARY OF THE INVENTION

A socket, for a printed circuit board, according to the present invention comprises:

a housing having an insertion inlet defined between one pair of opposed walls to receive a printed circuit board to be connected;

a plurality of spring contacts having their contact points extending at least from one wall into the insertion inlet to provide arrays of contact points along a longitudinal direction of the insertion inlet;

a pair of latch arms each extending from an area near each longitudinal end of the insertion inlet of the housing and each having an integral structure of a cam section and latch section, the cam section being such that, when the printed circuit board is swung in a direction to press the contact points, each latch arm allows slide motion of a corresponding side edge of the printed circuit board to create a force along the direction of the array of contact points and the latch section latching the side edge of the printed circuit board swung clear of the cam section, and the pair of latch arms being adapted to be returned under their elastic force back to an unlatched position when each latch section unlatches the side edge of the printed circuit board;

one pair of support arms each extending from the housing along the corresponding latch arm and creating a gap relative to the adjacent latch arm; and a latch guide fitted in each support arm and having a guide section for allowing the latch arm to be slidingly quicked when the latch arm is moved between the latched position and the unlatched position, wherein the housing, latch arm and support arm are formed of an integral structure of an insulating material.

Preferably, the guide has a mount section fitted in the support arm and the guide section of the latch guide extends from one end side of the mount section toward the latch arm and an elastic section is provided in the latch guide and extends from the other end side of the mount section into the gap created between the latch arm and the support arm.

Preferably, the guide section is formed of a rectangular sheet-like section having two guide edges extending from the support arm toward the latch arm and the latch arm has two projections holding the guide section of the latch guide therebetween and slidably movable on the guide edges of the latch guide.

Preferably, the latch arm has a stopper face abutting against one surface of the printed circuit board to prevent excessive movement of the printed circuit board and the latch section is comprised of a projection provided at a predetermined distance from the stopper face and abutting against the other surface of the printed circuit board.

The socket, for the printed circuit board, according to the present invention is such that, when the printed circuit board is inserted into the insertion inlet of the housing, the contact points of the respective contacts are made in contact with conduction parts arranged on the edge portion, that is, the base end side of the printed circuit board. When the printed circuit board is swung against the urging force of the spring contact in a direction to press these contact points and, by so doing, the side edges of the printed circuit board are slidably moved along the cam sections of the respective latch arms, then the respective latch arms are displaced in opposite directions. This causes the pair of latch arms to be opened so that the latch section is placed to the unlatched position where the side edges of the printed circuit board can be unlatched. When the printed circuit board is further swung clear of the cam section, the latch arms are returned under their elastic force back to the latched position so that the latch sections are latched to the side edges of the printed circuit board to hold the printed circuit board in place.

When the latch arms are moved between the latched position and the unlatched position, it is slidably moved along the guide section of the latch guide. Since the support arm for supporting the latch guide, latch arm and housing are formed of an integral structure of an insulating material, metal members exposed at the insertion inlet are spring contacts only and it is possible to secure a safety upon attachment and detachment of the printed circuit board. Further, the latch arms are slidably moved along the guide section of the latch guide between the latch position and the unlatched position and the printed circuit board is smoothly mounted in place. The support arm, extending with a gap created relative to the latch arm, prevents the latch arm from being excessively bent.

In the case where the guide section and elastic section are provided in the latch guide and the elastic arm is located in the gap between the support arm and the latch arm, the latch arm has its elasticity varied under the elastic force of the elastsic section.

In the case where the guide section of the latch guide is formed of a rectangular sheet-like section with two guide edges provided there, the projections of the latch arm are slidably moved along the guide edges of the latch guide, thereby preventing twisting of the latch arm.

In the case where a stopper face for the printed circuit board is formed on the latch arm, the printed circuit board is positioned more accurately.

BRIEF DESCRIPTION OF THE DRAWINGS

FIGS. 1 to 6 show a socket 10, according to an embodiment of the present invention, which is used for a printed circuit board. As shown in FIG. 1, the socket 10 for the printed circuit board is equipped with a housing 14 where a greater number of spring contacts 12 are arranged at a predetermined internal. A pair of latch arms 16, 16, as well as a pair of support arms 18, 18, are provided such that each extends from each end of the housing 14. The support arm 18 supports a corresponding latch guide 20 as will be set out below. The housing 14, latch arms 16, 16 and support arms 18, 18 are formed of an insulating material, such as an LCP (liquid crystal polymer) and provide an integral structure. Reference numeral 22 denotes a polarity key for preventing an insertion error of the printed circuit board 8 (see FIGS. 3 and 5).

As shown in FIG. 2, the housing 14 has a pair of opposed walls 24, 26 arranged as upper and lower walls between which an insertion inlet 28 is defined so as to allow a printed circuit board 8 to be inserted. At each area near the corresponding longitudinal end of the insertion inlet 28 the latch arm 16 is coupled to the lower wall 26 and the upper surface of the latch arm at the insertion inlet 28 is situated in substantially the same plane as the upper surface of the lower wall 26 of the housing. For this reason, the latch arm 16 is of such a structure as to be smaller in cross-section than the support arm 18 and readily bendable, while, on the other hand, the support arm 18 has a relatively rigid structure.

The socket 10 of the present invention which is used for the printed circuit board is formed horizontal to the surface of a mother board, not shown, and mounted with the insertion inlet 28 situated in the horizontally open state. A positioning projection 13 is formed on the housing 14. From the array of contacts, the socket is formed for what is called a DIMM (dual in-line memory module).

Figure 3B:
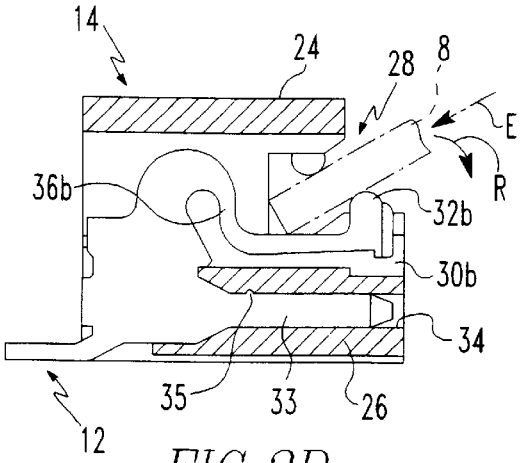
FIG. 3 is a cross-sectional view showing a state in which spring contacts are arranged in a housing.
Figure 3A:
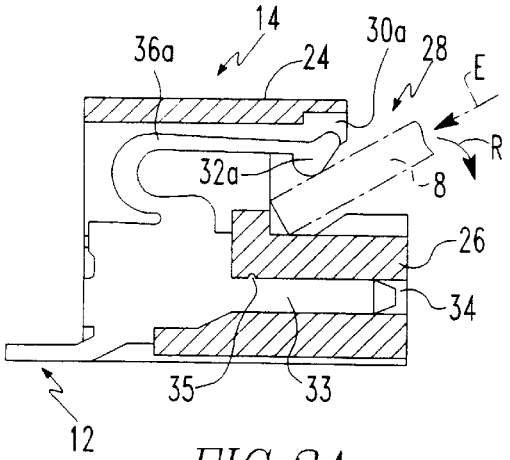

Contact grooves 30*a* are opened in the upper wall 24 on the insertion inlet 28 side and situated at a predetermined interval. Contact grooves 30*b* are also opened in the lower wall 26 of the housing on the insertion inlet 28 side and situated at a predetermined interval. The contact grooves 30*a* of the upper wall and contact grooves 30*b* of the lower wall 26 of the housing are alternately formed along the longitudinal direction and a corresponding spring contact 12 is mounted in the corresponding contact grooves 30*a*, 30*b*. A spring contact 12 as shown in FIG. 3(A) is fitted in the contact grooves 30*a* and a spring contact 12 as shown in FIG. 3(B) is fitted in the contact grooves 30*b*. These spring contacts 12 are, for example, punched out of a copper alloy.

As shown in FIG. 3, these spring contacts 12 each have a mount section 33 fitted in the housing 14 with a contact point (32*a*, 32*b*) supported by the mount section 33 via an elastic section (36*a*, 36*b*). The respective contact 12 is inserted from the back of the insertion inlet 28, that is, from the left side of the housing 14 as shown in FIG. 3 with the mount section 33 fitted in a corresponding one of mount holes 34 in the lower wall of the housing. A small projection 35 on the mount section of the contact prevents the contact from being slipped out of the mount hole 34. The contact point 32*a* of the contact, together with the elastic section 36*a* of the contact, is placed in the corresponding contact groove 30*a* of the upper wall 24 of the housing as shown in FIG. 3(A) and projected from the contact groove 30*a* into the insertion hole 28. The contact point 32*b* of the contact, together with the elastic section 36*b* of the contact, is placed in the corresponding contact groove 30*b* of the lower wall 26 of the housing as shown in FIG. 3(B) and projected from the contact groove 30*b* into the insertion inlet 28. A gap is provided between the contact point 32*a* and the contact groove 30*a* and a gap between the contact point 32*b* and the contact groove 30*b*. Further, a terminal section for connection to the mother board is projected from the back of the housing 14.

The contact points 32*a*, 32*b* of the respective spring contacts 12 provide, in the insertion inlet 28, contact point arrays along the longitudinal direction of the insertion inlet 28. These contact arrays are located in an offset relation to the direction E in which the printed circuit board 8 is inserted. When the edge portion of the printed circuit board 8 is inserted into the insertion inlet 28 and printed circuit board 28 is swung in a direction as indicated by an arrows R, the contact points 32*a*, 32*b* are urged by the edge portion of the printed circuit board, thus trying to return the elastic sections 36*a*, 36*b* of the contacts back to their original positions. By the spring-urged forces, the respective contact points against corresponding conductor 32*a*, 32*b* are pressed against corresponding conductor sections arranged on the edge portion of the printed circuit board so that their positive connections are secured. Further, an opposite moment acts upon the printed circuit board 8 in an opposite direction by the offset contact array.

Figure 4A:
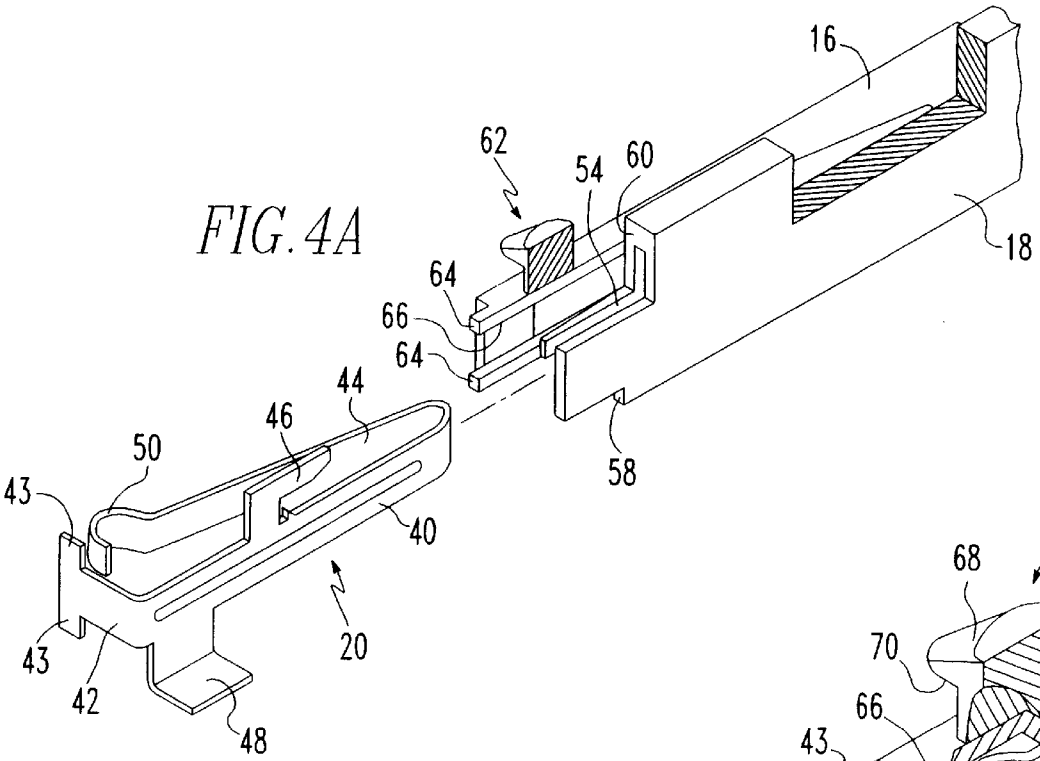
FIG. 4 is a perspective view, partly cut away, showing an arrangement of a latching mechanism.
Figure 4B:
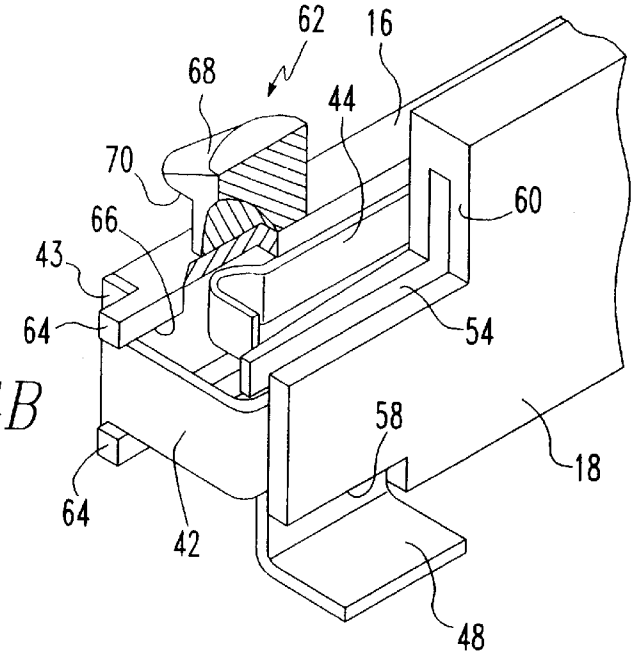

FIG. 4 shows latching mechanisms holding the printed circuit board 8 which receives such a moment at its respective side edges in a width direction of the circuit board 8. The latching mechanisms holding the respective sides of the circuit board have the same structures with respect to each other and only one of them is explained.

The latching mechanism of the present embodiment comprises the latch arm 16 extending from the housing 14, support arm 18, and latch guide 20 fitted into the support arm 18 to guide the latch arm 16.

As shown in FIG. 4(A), the latch guide 20 is formed of one sheet made of, for example, a copper alloy. The latch guide 20 of the present embodiment comprises a mount section 40 fitted in the forward portion of the support arm 18, guide section 42 bent substantially perpendicular from one end portion of the mount section 40, and a folded-back elastic section at the other end portion of the mount section 40. An L-shaped latch piece 46 is projected from the upper edge of the mount section 40 and a fixed leg 48 is projected from the lower edge of the mount section 40 so that it is fixed, by soldering for instance, to the mother board not shown. The guide section 42 has a rectangular sheet-like configuration forming guide edges at the upper and lower edges with projections 43, 43 provided in the upward and downward directions. The elastic section 44 is fitted between the latch arm 16 and the support arm 18 and has a curved section 50 which, when the latch arm 16 is bent, can abut against the latch arm 16.

Figure 5:
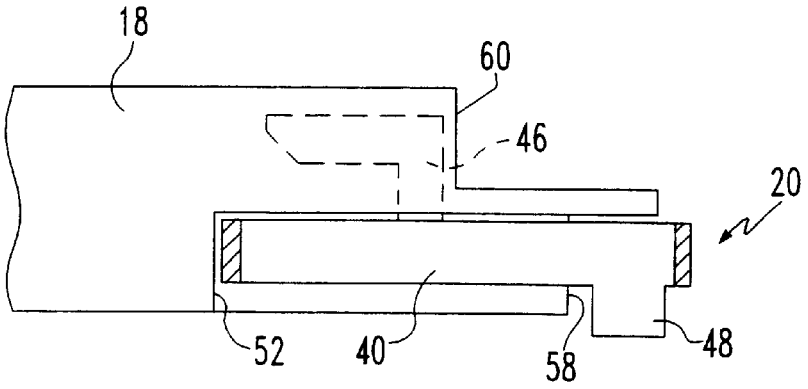
FIG. 5 is a partial, cross-sectional view diagrammatically showing a state in which a latch guide is fitted in a support arm.

As shown in FIG. 5, the support arm 18 has a holding recess 52 at its forward end portion to receive the mount section 40 of the latch guide 20 on the latch arm 16 is and also has a slot 54, as shown in FIG. 4, which, when the latch piece 46 is inserted via the forward end of the support arm 18, holds it in place. the cutout section 58 holds the fixed leg in place and the cutout 60 received an engaging projection 62 extending from the latch arm 16.

The latch arm 16 has two projections 64, 64 at its forward end side as shown in FIG. 4. A recess 66 is provided on the support arm facing side to receive the curved section 50 provided at the elastic section 44 of the latch guide 20. The engaging projection 62 is upwardly projected from the upper surface of the latch arm 16 and from the side of the latch arm 16 toward the support arm 18. An inwardly inclined cam section 68 is provided on the upper side of the engaging projection 62 and the engaging section 70 is provided at its lower side to latch the side edge portion of the printed circuit board. A lug 72 (FIG. 2) is provided on the support arm 18 side of the engaging projection 62. By the operation of the lug 72 the latch arm 16 is bendable between the engaged position (FIG. 1) in which the engaging projection 62 is latched to the side edge of the printed circuit board and the disengaged position (FIG. 6) in which the engaging projection is disengaged.

When the latch guide 20 is to be fitted in the support arm 18, it is inserted in the gap between the support arm 18 and the latch arm 16 with the latch piece 46 aligned with the slot 54. The elastic section 44 and curved section 50 are guided in the recess 66 of the latch arm 16 and the mount section 40 is located in the holding recess 52 (FIG. 5) of the support arm. In this state, the latch piece 46 is bitten into the wall of the support arm 18 to hold the latch guide 20 firmly in place and the mount section 40 abuts against the side surface of the holding recess 52. The projections 64, 64 of the latch arm 16 abut against the upper a guide edges of the latch section 42 and are prevented from being moved by the projections 43, 43 away from the support arm 18. With the latch guide 20 fitted in place, created between the curved section 50 of the elastic section 44 and the bottom surface of the holding recess 66.

Figure 6:
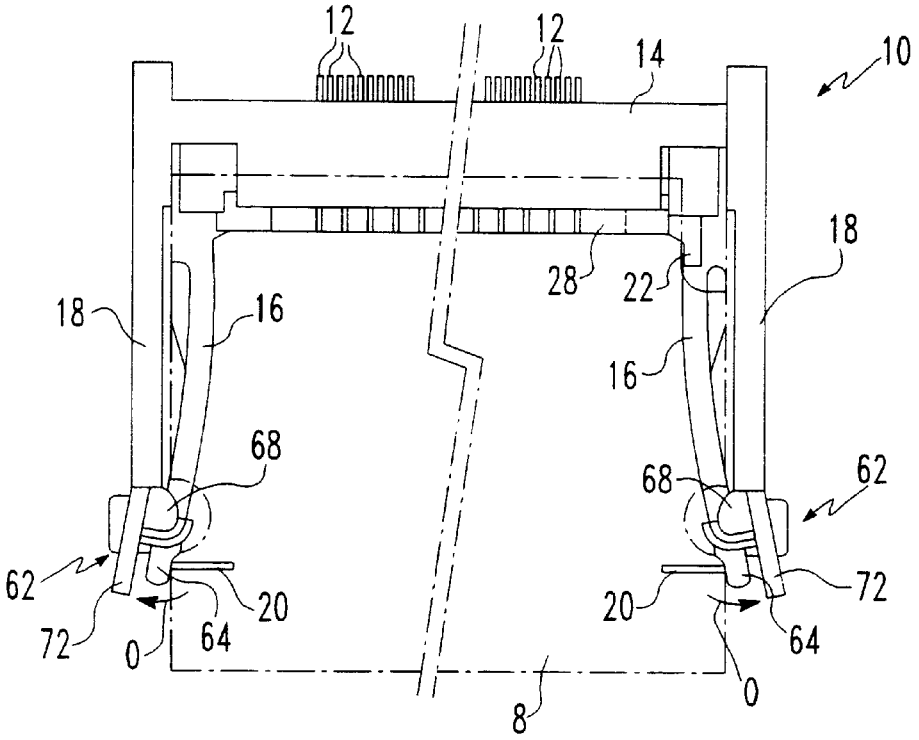
FIG. 6 is a plan view diagramatically showing the operation of latch arms.

FIG. 6 shows the operation of the latching mechanism.

Figure 1:
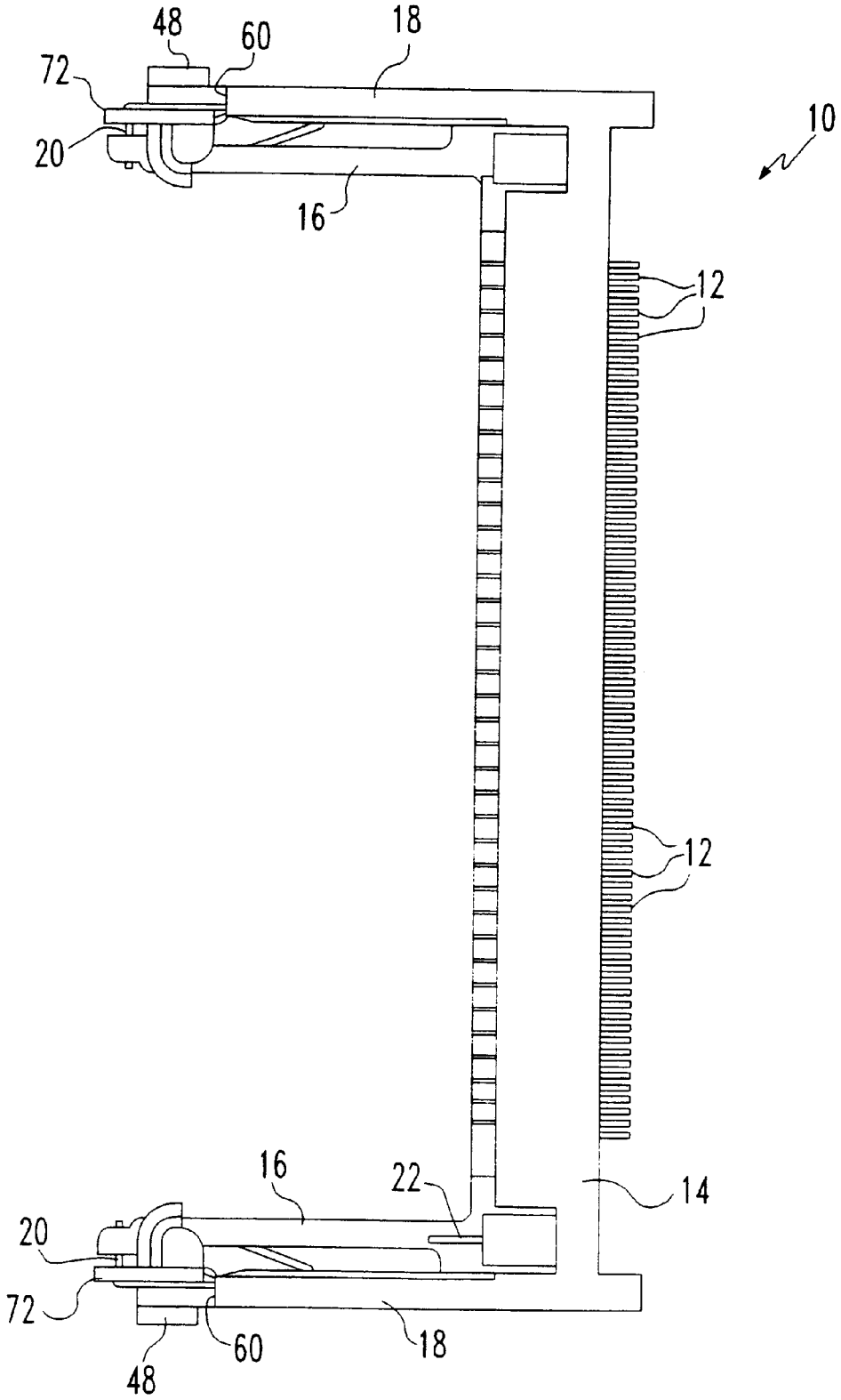
FIG. 1 is a plan view schematically showing a socket, according to an embodiment of the present invention, which is employed for a printed circuit board.
Figure 2:
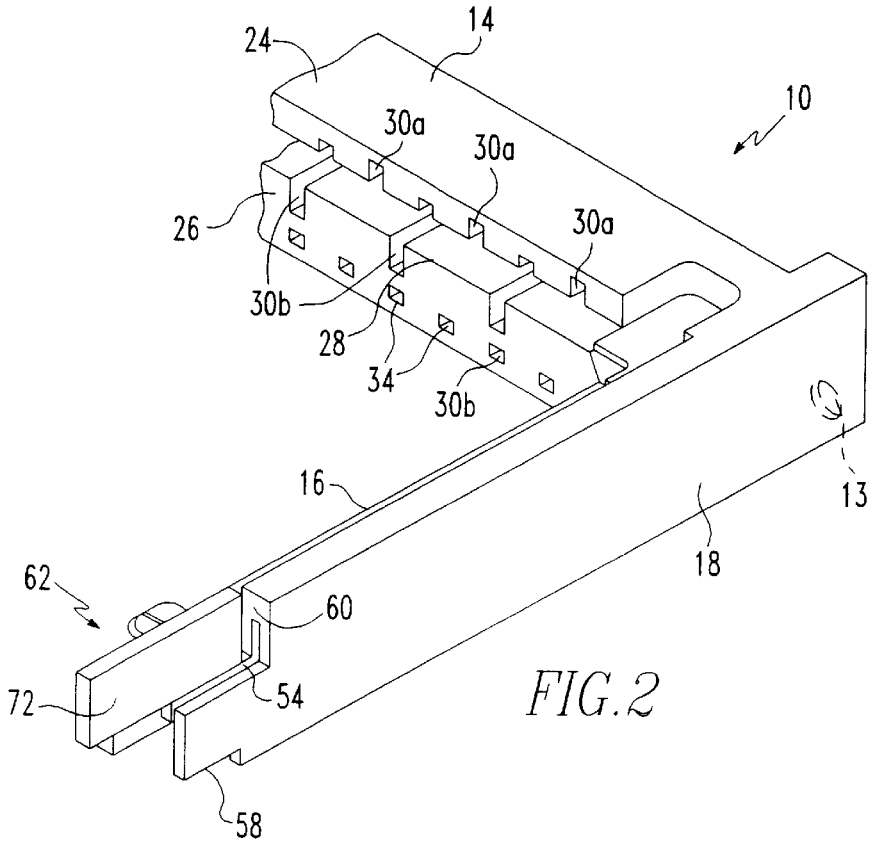
FIG. 2 is a perspective view schematically showing a partial structure of a housing.

When the printed circuit board 8 inserted into the housing 14 via the insertion inlet 28 is swung into abutting contact with the engaging projections 62 of the latch arm 16, the cam sections 68 of the engaging projections 62 urge the latch arms 16 in those directions as indicated by arrows in FIG. 6. Since the latch arms 16 are not contacted with the elastic sections of the latch guides, a displacement occurs immediately from the engaging position as shown in FIG. 1 and the projections 64 are slidably moved along the guide edges of the guide sections 42.

When the printed circuit board 8 is further swung, the latch arms 16, while urging the elastic sections 44 of the latch guides, are moved toward the support arms 18. By so doing, the latch arms 16, 16 are pushed away from each other and, with the further swinging of the printed circuit board 8 clear of the cam sections 68, the printed circuit board 8 is contacted with the upper surfaces of the latch arms 16, 16 and prevented from being excessively moved. Consequently, the latch arms 16, 16 are returned the latched positions under their own elastic force and an elastic force of the latch guides 20, whereby the latch sections 70 latch the side edges of the printed circuit 8 and hence the circuit board is held in the swung position.

According to the present invention, since the elastic section 44 is provided on the latch guides 20, even if the printed circuit board 8 is made in contact with the upper surface of the latch arm 16, it is possible to immediately return the latch arms 16 back to the initial positions.

When the printed circuit board 8 is to be detached, the latch arms 16 are moved by the lugs 72 in those arrow "O" directions to the disengaged position as shown in FIG. 6. By so doing, the latch sections 70 (FIG. 4) of the engaging projections 62 are disengaged from the printed circuit board 8 and the printed circuit board 8 is swung by an urging force of latch spring contact 12 away from the corresponding latch arm 16.

When the latch arms 16 are moved between the latched position and the disengaged (unlatched) position, the respective projections 43 are slidably guided on the guide edges of the respective guide sections 42 and the engaging projections 62 are moved along the flat surface of the printed circuit board 8 whereby the latch sections 70 of an insulating material smoothly engages with the side edges of the printed circuit board 8. Further, a bending direction force and torsional direction force acting from the printed circuit board 8 through the latch sections 70 to the latch arms 16 are transmitted to the support arms 18 through the guide section 42 and mount section 40 of the latch guide 20 and also to the mother board through the fixed leg 48. For this reason, the printed circuit board 8 is very firmly held in place while maintaining the easiness with which the latch arms 16 are bent. Further, the latch guide 20 made of a metal is held between the latch arm 16 and the support arm 18 and almost any metal portion is not exposed to an outside, thus ensuring the safety of the daughter board, etc.

Figure 7:
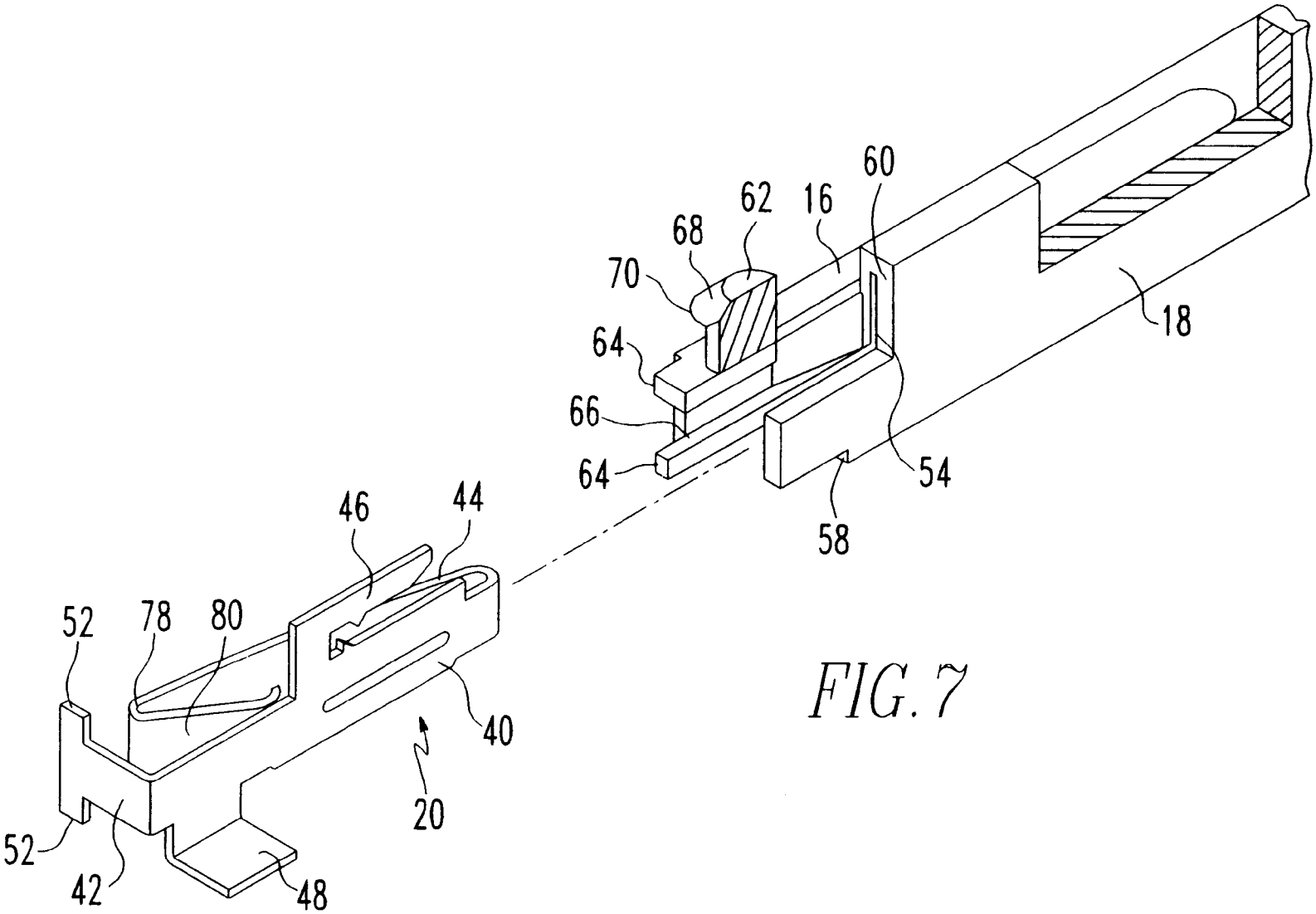
FIG. 7 is a perspective view diagramatically showing the operation of the latch arm.
Figure 8:
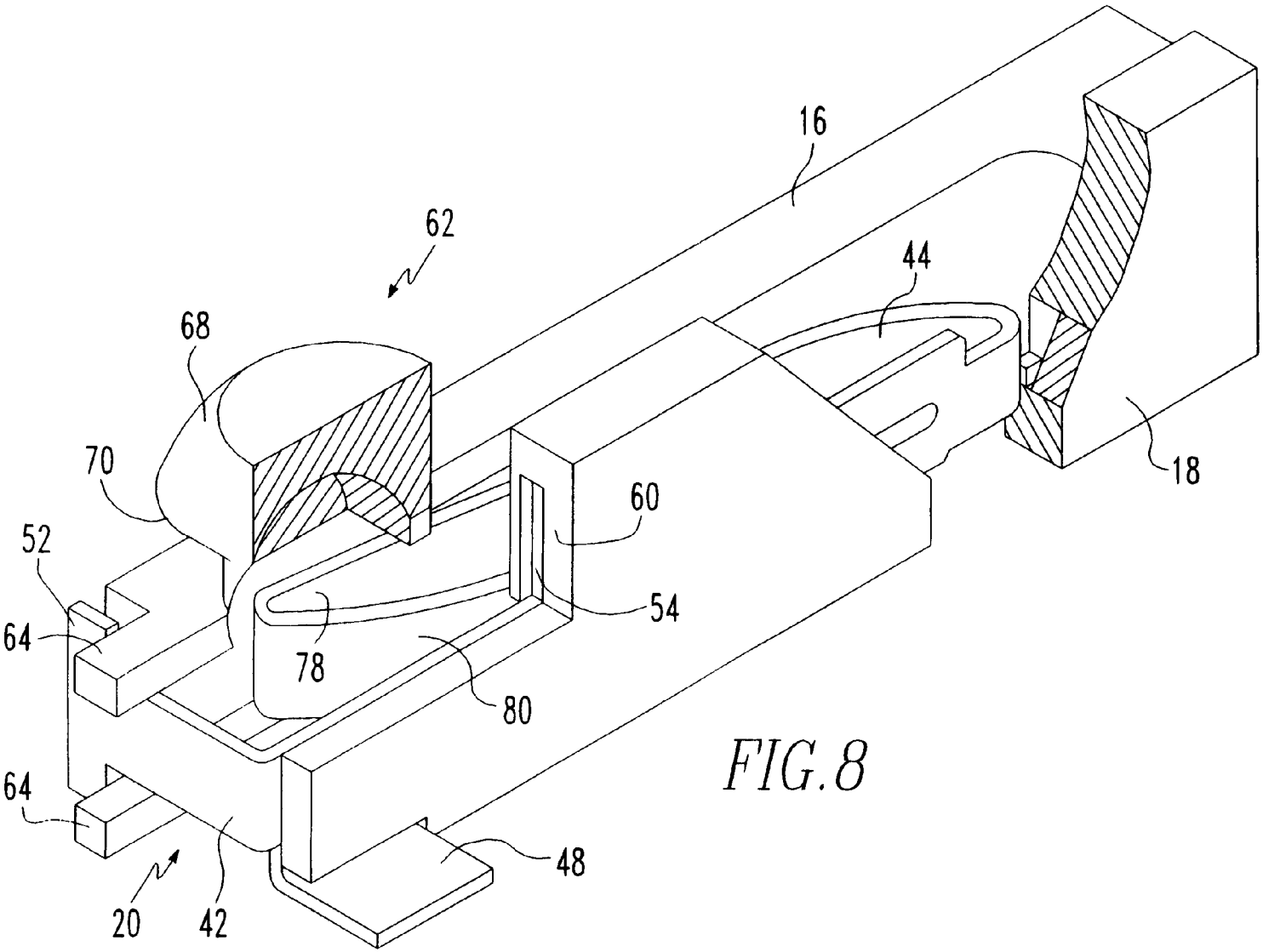
FIG. 8 is a perspective view showing a sate in which the latch guide is fitted in the support arm.

FIGS. 7 and 8 show a modification of the latching mechanism. In these figures, the same reference numerals are employed to designate parts or elements corresponding to those shown in the aforementioned embodiment and no further explanation is omitted.

This latching mechanism has not only an elastic section 44 but also an auxiliary elastic section 80. The auxiliary elastic section 80 is comprised of a bent-back section bent from the elastic section 44 at a bent portion. The forward end portion of the auxiliary section 80 is bent into a curved area and is of such a structure that the auxiliary section 80 is smoothly engages with the mount section 40. In the case where a gap is created between the curved area and the mount section 40, the elasticity of the latch arm 16 can be set in three stages. Upon the attachment and detachment of the printed circuit board, it is possible to obtain a state of engagement with an engaging projection 62 through a varying elasticity.

As evident from the above, according to the socket according to the present invention which is used for the printed circuit board, even if a greater number of spring contacts are used, it is possible to readily and positively attach or detach a printed circuit board to and from the socket without causing an injury to the printed circuit board and do so with the use of an insulating material.

In the case where the guide section and elastic section are provided on the latch guide and the elastic section is located in a gap between the support arm and the latch arm, a predetermined great elasticity can be obtained irrespective of the cross-section area of the latch arm.

Further, in the case where the guide section is comprised of a rectangular sheet-like section having two guide edges and the projections of the latch arms are slidably moved along the guide edges of the guide sections, the latch sections of the latch arms can smoothly slide on the printed circuit board.

Further, in the case where a stopper surface for the printed circuit board is provided on the latch arm, it is possible to prevent any excessive movement of the printed circuit board and to achieve more precise positioning.

What is claimed is:

1. A socket for a printed circuit board which comprises:

a housing having an insertion inlet defined between one pair of opposed walls to receive a printed circuit board to be connected;

a plurality of spring contacts having their contact points extending at least from one wall into the insertion inlet to provide arrays of contact points along a longitudinal direction of the insertion inlet;

a pair of latch arms each extending from an area near each longitudinal end of the insertion inlet of the housing and each having an integral structure of a cam section and latch section, the cam section being such that, when the printed circuit board is swung in a direction to press the contact points, each latch arm allows slide motion of a corresponding side edge of the printed circuit board to create a force along the direction of the array of contact points and the latch section latching the side edge of the printed circuit board swung clear of the cam section, and the pair of latch arms being adapted to be returned under their elastic force back to an unlatched position when each latch section unlatches the side edge of the printed circuit board;

one pair of support arms each extending from the housing along the corresponding latch arm and creating a gap relative to the adjacent latch arm; and a latch guide fitted in each support arm and having a guide section for allowing the latch arm to be slidingly quicked when the latch arm is moved between the latched position and the unlatched position, and the latch guide has a mount section fitted in the support arm and the guide section of the latch guide extends from one end side of the mount section toward the latch arm and an elastic section is provided in the latch guide and extends from the other end side of the mount section into the gap created between the latch arm and the support arm;

wherein the housing, latch arm and support arm are formed of an integral structure of an insulating material.

2. The socket according to claim 1 wherein the guide section is formed of a rectangular sheet-like section having two guide edges extending from the support arm toward the latch arm and the latch arm has two projections holding the guide section of the latch guide therebetween and slidably movable on the guide edges of the latch guide.

3. The socket according to claim 1 wherein the latch arm has a stopper face abutting against one surface of the printed circuit board to prevent excessive movement of the printed circuit board and the latch section is comprised of a projection provided at a predetermined distance from the stopper face and abutting against the other surface of the printed circuit board.

* * * * *